United States Patent [19]

Otsuka et al.

[11] Patent Number: 4,913,314

[45] Date of Patent: Apr. 3, 1990

[54] OPENING ELEMENT FOR AN INSERT NOZZLE OF A SLIDE GATE VALVE APPARATUS AND A METHOD OF OPENING SAID APPARATUS

[75] Inventors: Takashi Otsuka; Masaru Terao; Masahiko Nose; Kenji Yamamoto; Mototsugu Osada, all of Okayama, Japan

[73] Assignee: Shinagawa Refractories Co., Ltd., Tokyo, Japan

[21] Appl. No.: 286,828

[22] Filed: Dec. 20, 1988

[30] Foreign Application Priority Data

Dec. 23, 1987 [JP] Japan ..... 62-323786

[51] Int. Cl.[4] ..... B22D 41/08

[52] U.S. Cl. ..... 222/590; 222/600; 266/271

[58] Field of Search ..... 222/590, 600; 266/45, 266/272, 271

[56] References Cited

U.S. PATENT DOCUMENTS 4,795,066 1/1989 Worrell ..... 222/600

FOREIGN PATENT DOCUMENTS 0766728 10/1980 U.S.S.R. ..... 222/600

1581058 12/1980 United Kingdom ..... 222/600

*Primary Examiner*—S. Kastler

*Attorney, Agent, or Firm*—Larson and Taylor

[57] ABSTRACT

An opening element for an insert nozzle of a slide gate valve apparatus, wherein a dead weight having an outside diameter smaller than the inside diameter of the melt passage opening of the slide gate valve apparatus is connected to a refractory cap by means of a steel wire, or by a refractory or metallic coupling rod and a method of opening said slide gate valve apparatus wherein said opening element is set in said respective passage openings of the insert nozzle and of a bottom plate connected to the nozzle, and said opening element is opened by the impact load exerted when said dead weight falls down due to the opening of the slide gate valve apparatus.

9 Claims, 3 Drawing Sheets

OPENING ELEMENT FOR AN INSERT NOZZLE OF A SLIDE GATE VALVE APPARATUS AND A METHOD OF OPENING SAID APPARATUS

This invention relates to an opening element for an insert nozzle of a slide gate valve apparatus for a vessel for molten metal and a method of initially closing said slide gate valve apparatus.

Generally, a molten metal received by a vessel remains in the vessel for about 10–90 minutes, and then it is poured from a nozzle. To prevent the molten metal from solidification in the nozzle, the nozzle is packed with a packing material 4 as shown in FIG. 8.

When the nozzle is set to "open", therefore, the packing material flows out first and then the molten metal flows out.

Conventionally, a variety of packing materials were invented and they were put to practical use. However, the ratio (hereinafter referred to as natural opening ratio) for natural flowing-out of the molten metal after the opening of the nozzle has not yet reached 100%, and in case the nozzle does not naturally open it is necessary to open the nozzle by force by using an oxygen lance whereby various problems have occurred as follows:

(1) The nozzle opening work by using an oxygen lance is dangerous, and the worker therefor is always exposed to danger.

(2) The refractory nozzle is melted down due to the oxygen lance, and nozzle life is shortened. Further, in the worst case the melt may leak from the vessel because of abnormal melt-down.

(3) The nozzle opening work using the oxygen lance occasionally requires a long period of time (more than 3 minutes). Particularly, since the time allowed for ladle replacement in a continuous casting is generally 2–3 minutes, troubles may sometimes occur in continuous-continuous casting. In short, in some cases a continuous-continuous casting for 5 charges must be stopped after 3 charges.

(4) Oxygen and a steel pipe are required for the oxygen lance.

The inventors of this invention have conducted research and experiments to solve the above problems, and as a result they have succeeded in developing the present invention. The invention is technically constituted by an opening element for an insert nozzle of a slide gate valve apparatus, wherein a dead weight having an outside diameter smaller than the inside diameter of the melt passage opening of the slide gate valve apparatus is connected to a refractory cap by means of a steel wire, or by a refractory or metallic coupling rod, and by a method of initially closing said slide gate valve apparatus wherein said opening element is set in said respective passage openings of the insert nozzle and the bottom plate connected to the nozzle, and wherein said opening element is opened by the impact load exerted when said dead weight falls down due to the sliding of the slide plate thereby opening the slide gate valve apparatus.

The invention will now be described more in detail, by way of some embodiments, with reference to the accompanying drawings.

FIG. 6 is an example in which the cap is made plate-like;

Figure 1:
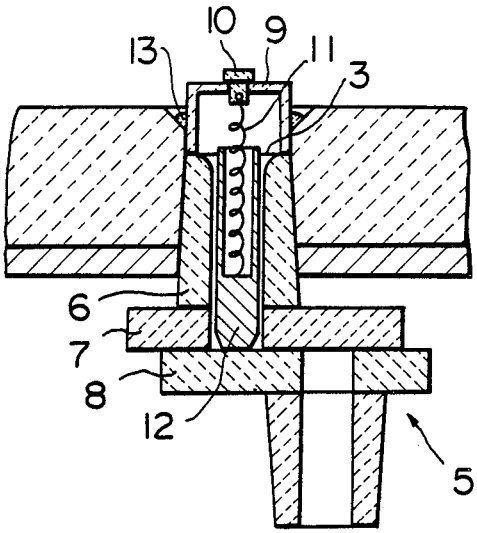
FIG. 1 is a sectional view showing the state in which the opening element for an insert nozzle of the invention is disposed in a slide gate valve apparatus.

As shown, a dead weight 12 having an outside diameter smaller than the inside diameter of the melt passage opening is coupled by a steel wire 11 with a plug 10 fitted in a cylindrical, refractory cap 9 of inverted cup shape. In FIG. 1, 7 is a fixed plate and 8 is a slide plate.

Figure 2:
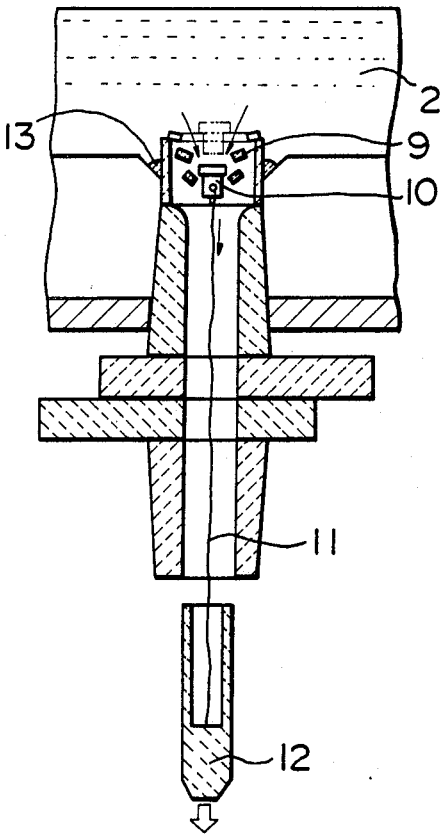
FIG. 2 shows a melt pouring state using the mechanism of FIG. 1.
Figure 3:
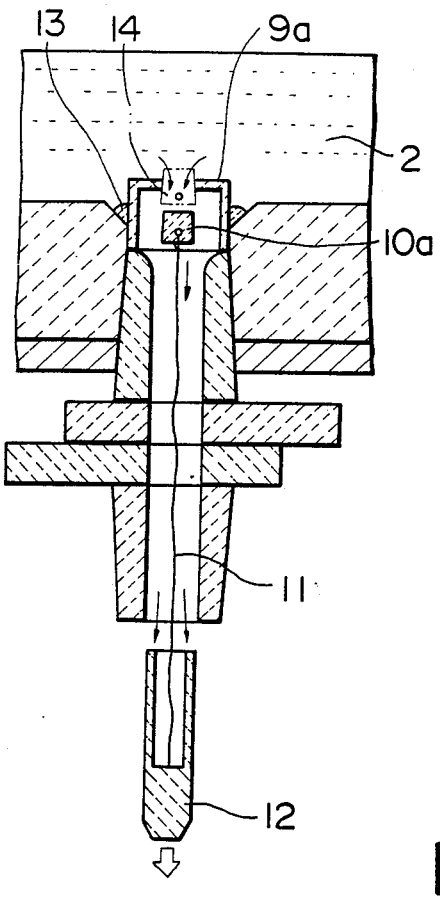
FIG. 3 is a schematic view similar to FIG. 2 in the case of using a cone-shaped plug.

FIG. 3 is almost same as FIG. 2 except that the plug 10*a* fitted in the cap 9*a* is tapered.

Figure 4:
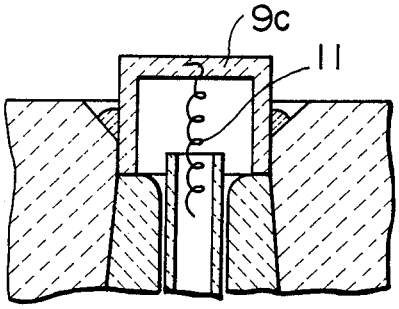
FIG. 4 is an example of mounting a dead weight directly to the cap.
Figure 5:
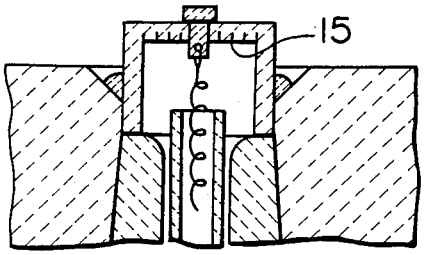
FIG. 5 is an example in which the cap is notched.
Figure 6:
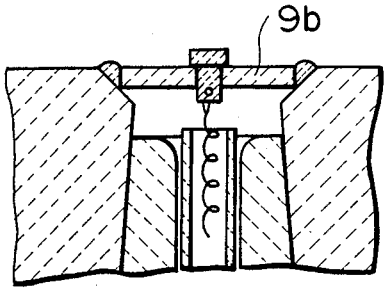

FIG. 4 shows an example in which a steel wire is connected directly to the bottom of a refractory cap 9*c* without using a plug. FIG. 5 shows an example in which the bottom of the refractory cap is provided with notches 15.

The opening element for an insert nozzle of the invention is constituted as described above, and a method of initially closing a slide gate valve apparatus by using said opening element is described below.

As shown in FIGS. 1 and 2, a plug 10 provided with a thin steel wire 11 is fixed on a refractory cap 9, and a dead weight 12 is mounted to the other end of the wire 11. In use, the slide gate valve is closed, the dead weight 12 is inserted into a nozzle 3, and the refractory cap 9 is set above an upper nozzle 6, with mortar 13.

When the nozzle of a slide gate valve 5 mounted to a molten metal vessel 1 containing a molten metal 2 is fully opened, the dead weight 12 falls down as shown in FIG. 2. Since the impact load applied by the falling-down of said dead weight is applied to the plug 10 through the thin steel wire 11, the upper portion of the cap 9 is broken to small pieces smaller than $\phi D$ and owing to the falling small pieces of the broken cap 9 within the nozzle 3 the molten metal 2 is naturally discharged. By $\phi D$ is meant the inside diameter of the melt passage opening.

For the cap 9*a* in FIG. 3, a material which is easily melted down by the molten metal 2 is selected in advance. By removing the plug 10*a* due to the load applied thereto the molten metal 2 flows out of an opening 14 for the plug, the residual portion of the cap 9*a* is quickly melted down by the molten metal 2, and therefore, the molten metal naturally flows out. The external dimension of said plug 10*a* is less than $\phi D$.

Figure 7:
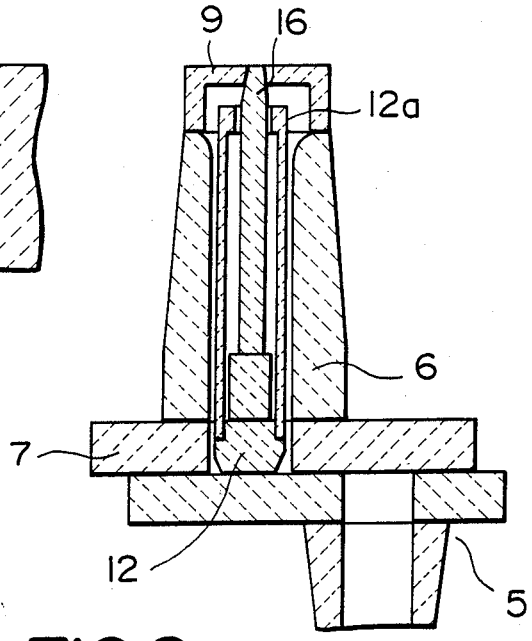
FIG. 7 is an example in which an extension portion of the plug instead of steel wire is coupled with the dead weight.
Figure 8:
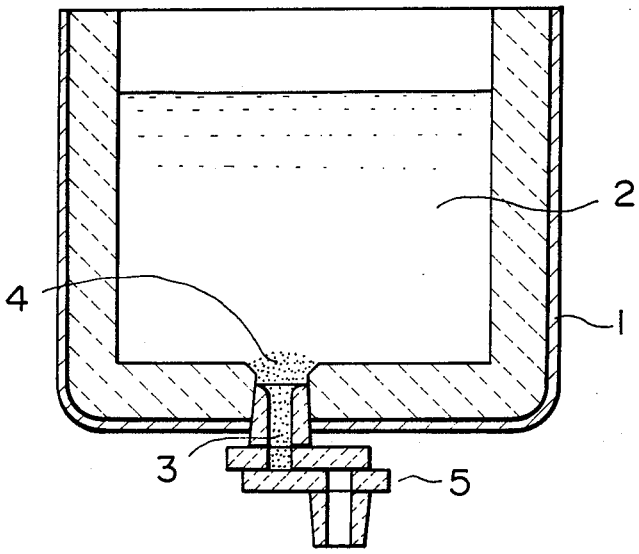
FIG. 8 is a sectional view showing the state in which the opening element for an insert nozzle of the invention is disposed in a slide gate valve apparatus.

FIG. 7 is a vertical sectional view showing an example where an elongate refractory or metallic plug 16 which is inserted into the refractory cap is an element for coupling with the dead weight 12. A portion 12*a* is provided to couple the dead weight 12 to plug 16. When dead weight 12 falls, portion 12*a* which is secured to dead weight 12 also falls until the inwardly projecting portions at the upper end of portion 12*a* engage the lower end of elongate plug 16. The impact of falling dead weight 12 is thus imparted to plug 16 through coupling member 12*a*, causing plug 16 to be pulled downwardly, thus opening refractory cap 9 for the flow of molten metal from the vessel. The anchoring portion 12a is secured to the dead weight 12 by screwing or the like, and the inwardly projecting portions provided in the uppermost of said anchoring portion 12a may be separately manufactured and secured by screwing or the like.

Anchoring portion 12a can be constructed in such a manner that it is split into two sections vertically for easy assembling.

(1) Refractory cap

The refractory cap has a strength endurable against the head pressure of the molten metal 2.

In breaking, it is broken to small pieces smaller than ϕD of the nozzle diameter.

In melting down, it is easily melted down by the molten metal which flows within the opening of less than ϕD, from which opening the plug 10a has been taken out.

The shape of the refractory cap may be either cylindrical with bottom or flat plate-like (9b). Moreover, to accelerate an easy breaking the cap may be provided with notches 15 (see FIG. 5).

(2) Plug

In breaking, a plug can be provided with the thin steel wire 11. The plug can stand the impact load caused by the falling down of the dead weight 12 and has a strength which can transmit the impact load to the cap.

In melting down, the plug is constructed in such a manner that a thin steel wire 11 can be provided, the plug stands the impact load caused by the falling down of the dead weight 12, and the plug 10a is easily removable (namely a draft is provided).

(3) Thin steel wire

The wire is not easily extended and not damaged by the impact load caused by the falling down of the dead weight 12.

It has a sufficient length so that the dead weight 12 may not collide against an object below when the weight has fallen down.

(4) Dead weight

In breaking, the dead weight may have a sufficient weight to be able to break the cap 9.

In melting down, it may have a sufficient weight to be able to withdraw the plug 10a.

The characteristics to be possessed by each part have been described above, but the plug 10 is not necessarily required and a thin steel wire may be attached directly to the refractory cap 9a as shown in FIG. 4.

According to the invention, it is possible to open the nozzle by force and assuredly by mechanical, external force, so that the above problems encountered in known techniques are avoided thereby making safe working and reliable operation possible. Refining outside the furnace, such as under LF (Ladle Furnace Process) or RH (Rheinetahl-Hereus Process), is being carried out. Molten metal is thus likely to stay in the vessel for a longer period of time, and because of this the natural opening ratio is lowered. Even in such case, the nozzle can be naturally opened according to the invention.

We claim:

1. Apparatus for discharging molten metal from a vessel comprising:

a slide gate valve for discharge of molten metal from the vessel, said slide gate valve having a fixed plate, a slide plate, and a melt passage openable and closable by sliding said slide plate;

means for initially closing said melt passage, said closing means comprising a refractory cap closing the upper end of said melt passage, thereby preventing entry of molten metal from said vessel into said melt passage, a dead weight positioned in said melt passage above said slide plate and having a size which is smaller than the opening of said melt passage whereby, on opening said slide gate valve, said dead weight is free to fall downwardly through said melt passage, and a coupling member joining said dead weight to said refractory cap, said coupling member allowing the dead weight to fall a limited distance, whereupon the falling dead weight exerts an impact load through said coupling member sufficient to open said refractory cap whereby molten metal is free to flow from said vessel and through said melt passage for discharging molten metal from said vessel.

2. Apparatus according to claim 1 wherein said refractory cap comprises a plug fitted in an opening in said refractory cap and wherein said coupling member is joined to said plug, said impact load being sufficient to pull said plug from said opening whereby molten metal may flow from said vessel through said opening in said refractory cap.

3. Apparatus according to claim 2 wherein said refractory cap is fabricated of a material which is melted by molten metal flowing from said vessel through said opening in said refractory cap.

4. Apparatus according to claims 2 or 3 wherein said coupling member comprises a wire.

5. Apparatus according to claims 2 or 3 wherein said coupling member comprises a rigid member.

6. Apparatus according to claims 2 or 3 wherein said coupling member is joined directly to said refractory cap, said impact load being sufficient to rupture said refractory cap.

7. Apparatus according to claim 1 wherein said infractor cap is plate-shaped.

8. Apparatus according to claim 1 wherein said refractory cap is inverted cup-shaped.

9. A method of initially closing the melt passage of a slide gate valve mounted on a vessel for discharge of molten metal from the vessel, said slide gate valve having a fixed plate, a slide plate, and a melt passage openable and closable by sliding said slide plate, said method comprising:

mounting a refractory cap at the upper end of said melt passage to prevent the entry of molten metal from said vessel into said melt passage; positioning a dead weight in said melt passage above said slide plate, said dead weight being smaller in size than the opening of said melt passage whereby, on opening said slide gate valve, said dead weight is free to fall downwardly through said melt passage;

said dead weight and refractory cap being joined by a coupling member which, on opening said slide gate valve, allows the dead weight to fall a limited distance whereupon the falling dead weight exerts an impact load through said coupling member sufficient to open said refractory cap whereby molten metal is free to flow from said vessel and through said melt passage for discharging molten metal from said vessel.

* * * * *